US005664410A

United States Patent [19]

Nydick

[11] Patent Number: 5,664,410

[45] Date of Patent: Sep. 9, 1997

[54] CHAIN LINK, CHAIN MADE THEREFROM AND METHOD OF CHAIN MANUFACTURE

[76] Inventor: Andrew Nydick, 22 Goodhart Dr., Livingston, N.J. 07039

[21] Appl. No.: 656,883

[22] Filed: May 30, 1996

[51] Int. Cl.[6] ..... F16G 13/00

[52] U.S. Cl. ..... 59/80; 59/82

[58] Field of Search ..... 59/80, 82, 35.1, 59/78; 63/4

[56] References Cited

U.S. PATENT DOCUMENTS

| | | | |
|---|---|---|---|
| 1,414,638 | 5/1922 | Grove | 59/80 |
| 2,714,269 | 8/1955 | Charles | 59/80 |
| 2,807,928 | 10/1957 | Wills | 59/80 |
| 2,972,833 | 2/1961 | Grutta | 59/80 |
| 3,418,803 | 12/1968 | Martin | 59/80 |
| 4,448,017 | 5/1984 | Stark | 59/80 |

*Primary Examiner*—David Jones
*Attorney, Agent, or Firm*—Lawrence C. Edelman, Esq.

[57] ABSTRACT

A link and a chain formed therefrom, wherein the links comprise a shaft portion having first and second opposing ends defining therebetween a longitudinal axis for the link; an enlargement portion connected to the shaft portion at the first end, the enlargement portion having a width which is greater than a width of the shaft portion at the first end; and a mandorla shaped portion having first and second apertures therein, the mandorla shaped portion being connected to the shaft portion at the second end, and the apertures being shaped so as to prevent the enlargement portion from passing therethrough.

20 Claims, 1 Drawing Sheet

CHAIN LINK, CHAIN MADE THEREFROM AND METHOD OF CHAIN MANUFACTURE

BACKGROUND OF THE INVENTION

1. Field of the Invention

The present invention relates to a novel chain link, chain made therefrom, and a method of chain manufacture. The link is particularly useful for the manufacture of jewelry chain, formed, for example into ornamental necklaces, bracelets, belts, etc.

2. Description of the Prior Art

Jewelry chains serve principally a decorative purpose, and are used in a variety of ways. For example, jewelry chains may be used for necklaces, bracelets, belts, etc. Typically, chains consist of a series of links looped together to form the chain.

Various jewelry chains comprising plural loop-type links and methods of assembly have been proposed in the past. For example, in U.S. Pat. No. 4,448,017 Stark provides a chain loop element comprising a wire ring crimped together to form a teardrop shape. One end of the teardrop shape has a loop, and the other end has two parallel wires. Plural links are joined together by passing the two parallel wires of one link through the loop portion of an adjacent link. An ornament, such as a bead, etc. is attached to the end of two parallel wires passed through the adjacent link, so as to secure the links together. Such links, and chains manufactured therefrom, are somewhat undesirable, since the ornaments used for securing the links together protrude from the chain and may tend to catch clothing, etc. of the user and/or others. In the event that the ornaments used comprise precious or semiprecious stones, their protrusion from the chain tends to expose them to undesirable abuse, possibly causing their loss. Additionally, due to the round nature of both the teardrop loop and the two parallel wires passing therethrough from the adjacent link, there is no way to adjust the bend and stretch characteristics of the chain to suit various uses. Furthermore, the crimping, or other means used to form the teardrop shape from the wire ring, is somewhat unattractive, and merely provides the operating function needed for completing the chain links.

Accordingly, there is a need for a new link and chain made therefrom that allows adjustment of the bend and stretch characteristics of the chain so as to suit various uses, and which takes not only the functional characteristics of the chain into consideration, but is enhances the aesthetic qualities of the chain.

SUMMARY OF THE INVENTION

In accordance with he principles of the invention, a link for forming a chain comprises a shaft portion having first and second opposing ends defining therebetween a longitudinal axis for the link; an enlargement portion connected to the shaft portion at the first end, said enlargement portion having a width which is greater than a width of the shaft portion at the first end; and a mandorla shaped portion having first and second apertures therein, the mandorla shaped portion being connected to the shaft portion at the second end, and the apertures being shaped so as to prevent the enlargement portion from passing therethrough.

DETAILED DESCRIPTION OF THE PREFERRED EMBODIMENT

Initially, it is noted that although the illustrated preferred embodiment of the invention is in the context of a chain for jewelry purposes, the invention is equally applicable for making chain for use in areas other than jewelry, such as belts for machinery and gears.

Figure 1:
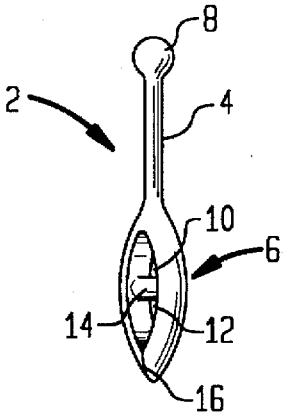
FIG. 1 is a front perspective view of a chain link constructed in accordance with the principles of the present invention.

As shown in FIG. 1, the new link 2 comprises a shaft portion 4, a enlargement portion 8, and a dual-apertured mandorla shaped portion 6. Shaft portion 4 has one end connected to the enlargement portion, such as a ball 8, and its other end connected to the mandorla shaped portion 6. Portion 6 has first and second apertures 10 and 12, respectively, formed therein, due to the presence of a cross bar 14. Note, as will be explained in a moment, cross bar 14 is only connected to mandorla portion 6 at one of its inside edges.

Figure 2:
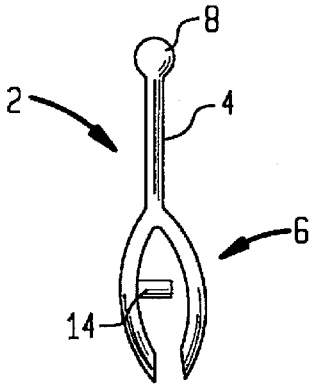
FIG. 2 is a front elevation view of the chain link of FIG. 1, prepared for assembly with another link similar to the link of FIG. 1, for forming a chain.
Figure 3:
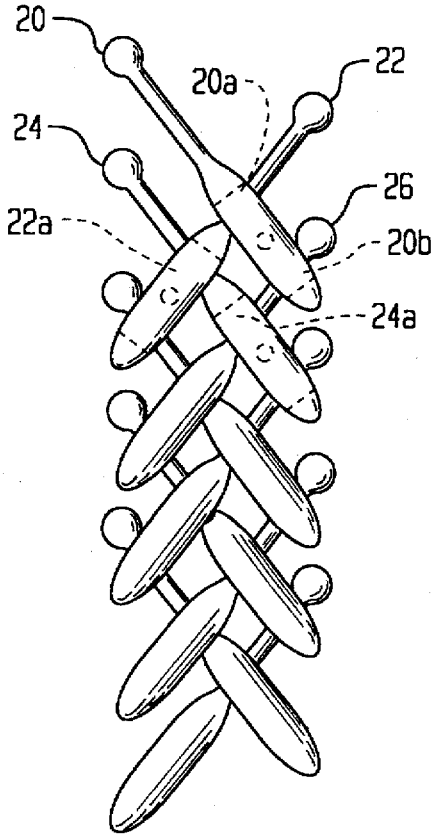
FIG. 3 is a front elevation view of a chain assembled using a plurality of the links shown in FIG. 1.

Link 2 may be formed by hand using pieces of round and half-round wire, but in the preferred embodiment, link 2 is formed using casting techniques. Casting techniques for forming links, especially those useful for jewelry, are well know to those of ordinary skill in the art, and therefore description of making the casting mold will be largely omitted. However, it is noted that when making the model for the casting a round wire was used for making shaft portion 4 and cross bar 14, and half-round wire was used for making the mandorla shaped portion 6. Alternatively, bezel wire having a "c" shaped cross-section could be used for making the model of the mandorla portion 6, so as to maintain the appearance of substantial size for the link, while reducing its weight and the amount of precious material used to make the link. The mandorla portion 6 and the ball 8 were then soldered to opposite ends of shaft 4 and the end of the mandorla portion 6. Next, the link tip 16 is cut so as to separate the tip of the link in half, along the horizontal axis 18. The link is then "opened" up using two pairs of pliers, each half of the mandorla portion 6 being held by one of the pliers. Pressure is then exerted so as to separate the two halves until they are as shown in FIG. 2. The link is opened until there is enough space between the free end of cross bar 14 and the inside wall of the other half mandorla portion 6, so as to permit the passing of a shaft portion 4 therethrough. This completes manufacture of the model to be used for manufacturing all subsequent links by casting. The casting can be accomplished in accordance with any of several well known techniques.

The above mentioned link is the basic shape for the production of a chain. There are alterations that can be made to the shape of the link to facilitate various methods of manufacturing, and some of these methods will be discussed later at the end of this section.

To assemble the chain, there is a repeating pattern of links that is established. Initially, a link 22 has it's shaft portion inserted into the first aperture 20*a* of a link 20. Next, the shaft portion 4 of a link 24 is inserted into the first aperture 22*a* of link 22, and then positioned so that links 20 and 24 are substantially parallel to one another and their mandorla and enlargement portions 6 and 8 are oriented in the same direction. Next, the shaft portion 4 of a link 26 is inserted through a first aperture 24*a* of link 24 and then through the second aperture 20*b* of link 20, and positioned so that links 22 and 26 are substantially parallel to one another and their mandorla and enlargement portions 6 and 8 are oriented in the same direction, and so that links 20, 22, 24 and 26, when so arranged, form a parallelogram shape. After each link has a shaft portion inserted in both its apertures, it can be closed using a pair of pliers, and then it's tip 16 is soldered. For forming a chain of any desired length, the parallelogram shaped pattern established by links 20, 22, 24 and 26 is repeated with as many additional links as needed.

Figure 4:
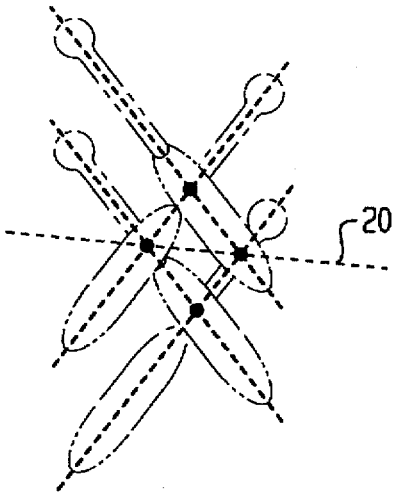
FIG. 4 is a schematic view of a portion of the chain of FIG. 3, illustrating preparation of the chain for attachment of a clasp thereto.

A technique for attaching a clasp (not shown), to finish the chain for jewelry, is shown in FIG. 4. To attach the clasp, first, the chain must be made continuous by connecting its free ends together. This is accomplished by connecting the end of the chain with the balls 8 into the appropriate ones of apertures 10 and 12 in the other end of the chain. Then, the last three mandorla portions 6 can be soldered closed. Next, for a set of four adjacent links, the shafts 4 are connected to the apertures 10 and 12 through which they pass, by e.g., soldering. This connects the four adjacent links together to form a unified base to receive the clasp. Next, the unified piece is cut in half along an axis 20. Then, on one end of the chain a clasp tongue is attached, and on the other side, enough metal is burred out on it's underside to accommodate the clasp box. The box is then soldered in place, a safety is attached, and then the finished necklace (or bracelet, etc) is cleaned, stamped and polished. Alternatively, instead of unifying four links, a model of these unified four links can be cast and used, thereby saving a lot of clasp assembly time.

The size and shape of the shaft, the wires used to form the apertured mandorla portion and the diameter of the ball are all critical to the proper functioning of the chain. If the ball is too small, it will fall through the apertures and the chain would fall apart. If the diameter of the shaft is too large, it will inhibit the flexibility of the chain by making it "stiff". A large diameter for the wire forming the mandorla will decrease the open space, or width, in which the shaft portion moves. This decrease in moving space makes the shaft lock-up and prevents any further movement along the longitudinal axis of the chain. If a smaller diameter round wire is used for forming the mandorla, more moveable space is created therefore making the chain "looser" and giving more flexibility along the longitudinal axis. While control of the movement along the longitudinal axis is desired so that one can regulate this characteristic for the specific utility of the chain, for it's use as jewelry, there is a critical wire diameter size. This is due to the metals used in jewelry. Gold, silver and platinum are soft metals and can only take a certain amount of stress or impact before becoming deformed. Too small of a diameter will result in a very loose chain but more importantly, the wire will be too frail, and can be easily bent and deformed through normal use of the chain. Simply put, it will bend itself out of shape and will loose its regular repetitive pattern. Too large a diameter wire will result in a limited flexibility along the longitudinal axis, which inhibits its usability as a jewelry chain. If the chain is not flexible, then it will be uncomfortable and potentially dangerous to the wearer.

The length of the shaft is also critical. If it is too short it will not have the length needed to allow the chain to have flexibility along an axis perpendicular to the longitudinal axis. Not only will the flexibility in the perpendicular axis be inhibited but flexibility along the longitudinal axis will be inhibited as well. This is due to the critical angles created in the parallelogram shaped pattern between the ball-shaft connection and the top inside aperture. By preventing the aperture from having the ability to slide further down the shaft, the ball-shaft connection is locked into the inner wedge of the aperture, thus decreasing the amount of movable space. This inhibits a lot of the movement of the chain on the perpendicular axis as well as the longitudinal axis. Just as the size of the diameter and length of the shaft is critical to manufacture a chain having certain desired characteristics, so to is the size of the aperture to the size of the shaft. If the aperture is large compared to the shaft diameter, then there will be greater mobility. If the aperture is too small there will be less mobility. The sizes of the shaft and the aperture are completely co-dependant. Any alteration of one of the critical sizes will affect the mobility of the chain and will require an alteration of all other critical sizes to return the link to it's desired mobility. For the purpose of jewelry, the chain must be flexible enough along it's longitudinal axis to wrap around a wrist and flexible enough along an axis perpendicular to the longitudinal axis, i.e., a top-bottom axis, to curve around a neck. Torsion of the chain is also controlled by the sizes of the shaft and the aperture. The larger the shaft size and/or the smaller the aperture size, the less torsion the chain will have. The smaller the shaft size and/or the larger the aperture size, the more torsion the chain will have.

The ability to manipulate the size of different portions of the link, such as the diameter and length of the shaft, and the dimensions of the apertures, etc, allows for a desired change in the size of a portion of the link for producing a deliberate affect in the chain's characteristics, such as its flexibility, stretch, etc. For maintaining the remaining desirable characteristics of the chain, a corresponding change should be made in the size of the remaining portions to return the chain characteristics back to acceptable ranges. For example, to scale-up all the link dimensions to make a larger size link might make for a necklace which is too heavy to be worn as jewelry. To reduce the diameter of the shaft wire will allow for a smaller length of the shaft, a smaller aperture and therefore a smaller ball. This will reduce the mass (weight) of the link while maintaining its size.

Representative dimensions for a "medium" sized link are as follows: Diameter of ball 8=3.25 mm; Diameter of shaft portion 4=1.45 mm; Length of shaft portion 4=6.5 mm; Length of mandorla portion 6=14.7 mm; Diameter of cross bar 14=1.28 mm; Length of cross bar 14=3.3 mm; Mandorla sides=high halfround wire 1.35 mm high and 2.37 mm wide; and the longitudinal dimension of apertures 10 and 12 is approximately 5 mm.

Thus, what has been shown and described is a novel link for a chain, a chain made therefrom, and a method of chain manufacture which fulfills all the stated desires and objects therefore. Changes, modifications, variations and other uses and applications of the subject invention will become apparent to those skilled in the art after considering this specification and its accompanying drawings, which disclose preferred embodiments thereof. For example, although a rounded shape wire was used for making links 2, rectangular shaped wire could have been used. Additionallly, the mandorla shaped portion 6 could have been formed to have a more rectangular (instead of almond) shape, and instead of having a ball 8 at the end of shaft 4, a square shaped enlargement could have been used.

Furthermore, although a preferred method of manufacturing has been described, alternate methods are also possible. for example:

1) Make the same shaped model, however, instead of cutting it open at tip 16 of the link, it's opened at the portion where the mandorla joins the shaft portion 4. The assembly would be the same as the embodiment described, however, instead of soldering together the tips 16 of mandorlas 6, the portion near the shaft is soldered closed.

2) Make the same shaped model, however, do not cut it at all. Instead, pry the link open enough to allow the passage of the ball through the apertures, and then crimp it closed.

3) Take the same shaped model, however, the ball is cut off. Drill a hole completely through the ball. Then solder onto the end of the shaft a piece of wire with a slightly smaller diameter than the hole in the ball. The length of the wire should be a little bigger than the diameter of the ball. Do not make any cut into the mandorla side of the link. Then to assemble; slide the shafts through the apertures and slide the balls onto the small wire on the top of the shafts. Then solder the balls onto the shaft.

All such changes, modifications, variations and other uses and applications which do not depart from the spirit and scope of the invention are deemed to be covered by the invention which is limited only by the claims which follow.

I claim:

1. A link for forming a chain using a plurality of similarly configured links, said link comprising:

a shaft portion having first and second opposing ends defining therebetween a longitudinal axis for said link;

an enlargement portion connected to said shaft portion at said first end, said enlargement portion having a width which is greater than a width of said shaft portion at said first end; and a mandorla shaped portion having first and second apertures therein, said mandorla shaped portion being connected to said shaft portion at said second end, and the apertures being shaped so as to prevent an enlargement portion of another one of said similarly configured links from passing therethrough.

2. The link of claim 1, wherein said mandorla shaped portion is elongated along said longitudinal axis, with said first and second apertures being serially arranged along said longitudinal axis.

3. The link of claim 2, wherein said enlargement portion comprises a ball-shaped portion having a diameter that prevents its passage through either of said first and second apertures in said mandorla shaped portion.

4. The link of claim 2, wherein said shaft portion has a maximum diameter which is smaller than the width of either of said first and second apertures.

5. The link of claim 1, wherein said first and second apertures each have similar dimensions.

6. The link of claim 1, wherein said enlargement portion is formed integrally with said shaft portion.

7. The link of claim 1, wherein said enlargement portion comprises a ball-shaped portion formed separately from said shaft portion and later connected to said first end of said shaft portion.

8. The link of claim 1, wherein said mandorla shaped portion is formed integrally with said shaft portion.

9. The link of claim 1, wherein said shaft portion is cylindrically shaped, and said mandorla shaped portion is formed with outer walls having a "c" shaped cross-section.

10. A chain comprising a plurality of similarly configured elongated links, each of said links comprising a shaft portion having first and second opposing ends defining therebetween a longitudinal axis for said link, an enlargement portion connected to said shaft portion at said first end, said enlargement portion having a width which is greater than a width of said shaft portion at said first end, and a mandorla shaped portion connected to said shaft portion at said second end and having first and second apertures serially arranged along said longitudinal axis, said first aperture being closest to said shaft and said second aperture being remote from said shaft, and the apertures being shaped so as to prevent the enlargement portion of another one of said similarly configured links from passing therethrough, wherein:

a) the shaft portion of a second one of said links passes through the first aperture of a first one of said links;

b) the shaft portion of a third one of said links passes through said first aperture of said second one of said links, and positioned so that said first and third links are substantially parallel to one another and their mandorla and enlargement portions are oriented in the same direction;

c) the shaft portion of a fourth one of said links passes through said first aperture of said third one of said links and also through said second aperture of said first one of said links, and positioned so that said second and fourth links are substantially parallel to one another and their mandorla and enlargement portions are oriented in the same direction, said first, second, third and fourth links, when so arranged forming a parallelogram shape; and d) additional links are arranged with their shafts passing through respective apertures of other ones of said links so as to repeat the parallelogram shaped pattern established by steps a) through c) with said additional links, for forming a chain of any desired length.

11. The chain of claim 10, wherein said enlargement portion comprises a ball-shaped portion having a diameter that prevents its passage through either of said first and second apertures in said mandorla shaped portion.

12. The chain of claim 11, wherein said shaft portion has a maximum diameter which is smaller than the width of either of said first and second apertures.

13. The chain of claim 10, wherein said first and second apertures each have similar dimensions.

14. The chain of claim 10, wherein said enlargement portion is formed integrally with said shaft portion.

15. The chain of claim 10, wherein said mandorla shaped portion is formed integrally with said shaft portion.

16. The chain of claim 10, wherein said shaft portion is cylindrically shaped, and said mandorla shaped portion is formed with outer walls having a "c" shaped cross-section.

17. A method of forming a jewelry chain comprising a plurality of similarly configured elongated links, each of said links comprising a shaft portion having first and second opposing ends defining therebetween a longitudinal axis for said link, an enlargement portion connected to said shaft portion at said first end, said enlargement portion having a width which is greater than a width of said shaft portion at said first end, and a mandorla shaped portion connected to said shaft portion at said second end and having first and second apertures serially arranged along said longitudinal axis, said first aperture being closest to said shaft and said second aperture being remote from said shaft, and said apertures each having a shape so as to prevent the enlargement portion of another one of said similarly configured links from passing therethrough, comprising the following steps:

a) inserting the shaft portion of a second one of said links through the first aperture of a first one of said links;

b) inserting the shaft portion of a third one of said links through said first aperture of said second one of said links, and positioning them so that said first and third links are substantially parallel to one another and their mandorla and enlargement portions are oriented in the same direction;

c) inserting the shaft portion of a fourth one of said links through said first aperture of said third one of said links and then through said second aperture of said first one of said links, and positioning them so that said second and fourth links are substantially parallel to one another and their mandorla and enlargement portions are oriented in the same direction, so that said first, second, third and fourth links, when so arranged form a parallelogram shape;

d) repeating the parallelogram shaped pattern established by steps a) through c) with additional links, for forming a chain of any desired length.

18. The method of claim 17, wherein said step of closing said opposing sides of the mandorla portion comprises soldering together the sides that were cut.

19. The method of claim 17, further including the steps of:

a) joining together the shaft portions of the links at one end of said chain with respective apertures in the mandorla shaped portions at an other end of said chain in a manner so as to maintain said parallelogram shaped pattern of said links and forming a continuous chain; and b) freezing the relative position of four adjacent ones of said links together with respect to each other;

c) cutting said chain apart at said four links frozen together by said prior step so as to form first and second chain ends; and d) affixing a clasp to said first and second chain ends.

20. The method of claim 19, wherein said freezing step comprises soldering together the links at the junction of their shaft and mandorla portions.

* * * * *